US007793876B2

(12) United States Patent
Wang

(10) Patent No.: US 7,793,876 B2
(45) **Date of Patent: *Sep. 14, 2010**

(54) LUBRICATING PACK HAVING VENTING HOLES AND SPECIFICALLY DESIGNED FOR PAPER SHREDDERS

(75) Inventor: Tie Chun Wang, Taipei (TW)

(73) Assignee: Michilin Prosperity Co., Ltd. (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/151,557

(22) Filed: May 7, 2008

(65) Prior Publication Data

US 2008/0210587 A1 Sep. 4, 2008

Related U.S. Application Data

(63) Continuation of application No. 11/180,690, filed on Jul. 14, 2005, now Pat. No. 7,387,270.

(51) Int. Cl.
*B02C 19/00* (2006.01)

(52) U.S. Cl. ..... 241/301; 241/100; 241/236

(58) Field of Classification Search ..... 241/101.2, 241/236, 100, 301; 83/168, 169; 206/484, 206/484.1, 484.2, 525; 184/6.1; 508/100
See application file for complete search history.

(56) References Cited

U.S. PATENT DOCUMENTS

| | | | | |
|---|---|---|---|---|
| 2,350,366 | A | 6/1944 | Mitchell et al. | |
| 2,595,708 | A | 5/1952 | Kopald | |
| 2,838,404 | A | 6/1958 | Cohen | |
| 7,166,561 | B2 | 1/2007 | Allen | |
| 7,387,270 | B2 * | 6/2008 | Wang | 241/301 |
| 2006/0169619 | A1 | 8/2006 | Wang | |
| 2006/0243631 | A1 | 11/2006 | Duke | |
| 2007/0080252 | A1 | 4/2007 | Pierce et al. | |

FOREIGN PATENT DOCUMENTS

| | | |
|---|---|---|
| DE | 3426979 | 1/1986 |
| DE | G8702207.9 | 6/1987 |
| DE | 29709492 U1 | 8/1997 |
| GB | 2187238 | 9/1987 |
| JP | 08001023 | 1/1996 |
| WO | WO 2006/036370 A2 | 4/2006 |

* cited by examiner

*Primary Examiner*—Mark Rosenbaum
(74) *Attorney, Agent, or Firm*—Venable LLP; Stefan J. Kirchanski

(57) ABSTRACT

A lubricating pack specifically designed for paper shredders, including a piece of oiled paper saturated with lubricant placed between two jackets that are each provided at an inner layer thereof with an oil-seepage-proof film. The two jackets are then formed with a first seal sealed around their peripheries to form a lubricating pack having a laminating construction. The lubricating pack is fed into the paper shredder through a paper inlet to the paper shredder under auto mode to be shredded by the paper shredder. Accordingly, the cutting blades of the paper shredder would be able to contact the lubricant contained in the oiled paper during the process of shredding the lubricating pack, so as to provide lubrication between cutting blades of the paper shredder thereby extending the lifespan of the paper shredder. Furthermore, to prevent the lubricant from spurting upwards along a paper inlet of the paper shredder caused by air compressed by the cutting blades that shred a tail end of the lubricating pack, a second seal may be formed at an inward of the peripheries, where plural venting holes are preformed between the first seal at the periphery and second seal inward of the periphery.

4 Claims, 2 Drawing Sheets

LUBRICATING PACK HAVING VENTING HOLES AND SPECIFICALLY DESIGNED FOR PAPER SHREDDERS

CLAIM OF PRIORITY

This application is a continuation application to U.S. Ser. No. 11/180,690, which was filed on Jul. 14, 2005 now U.S. Pat. No. 7,387,270.

BACKGROUND OF THE INVENTION

1. Field of the Invention

This invention relates to a paper shredder, particularly to a lubricating pack specifically designed for paper shredders so as to provide lubrication between cutting blades of the paper shredder upon direct contact with the lubricant, thereby extending the lifespan of the paper shredder.

2. Background

It is widely known that paper shredders for shredding incorporate plural cutting blades and spacers passing through rotary shafts that are driven to rotate towards each other by a motor and gear box so as to shred paper passing through the rotary shafts into strips by shear forces. Shredders can be classed into two types, the strip-cut shredders and crosscut shredders, according to the machine cutting style. The former shredders arrange cutting blades to the rotating cutter shafts in a manner for cutting the paper in a longitudinal direction to form strips. The later shredders include blades that include more than one cutting edge part, and each cutter is disposed helically along the rotary cutter shaft for first cutting paper along a horizontal direction into strips and then cutting paper along a longitudinal direction into paper chips.

Regardless of being strip-cut or crosscut shredders, the extended metal-to-metal contact and the high temperature generated in cutting paper due to concentrated stress that the cutting blades experience would dramatically reduce the cutting efficiency and shorten the lifespan of the paper shredders. Experiences prove that periodic lubrication and maintenance to the cutting blades can effectively resolve the afore-mentioned drawbacks.

U.S. Pat. No. 5,491,229 discloses a paper shredder with an improved lubrication system and method of lubricating; U.S. Pat. No. 5,186,398 discloses method and apparatus for lubricating the cutting elements of a shredding machine. Both patents intend to extend the lifespan of the paper shredder by providing lubrication to the cutting blades of the paper shredder. However, a closer look of the two patents reveals that, though they are able to serve the purpose of lubricating the cutting blades, the complicated constructions not only increase the manufacturing cost of the paper shredders, but also reduce the likelihood of commercializing the inventions. For example, the use of timers, oil pumps and manifolds all require additional peripheral devices that significantly increase the manufacturing cost. In addition, the use of oil drip to provide lubrication to the cutting blades requires precise control of oil drip amount and rate as well as lubrication uniformity, or resulting in insufficient lubrication or even fire hazards due to excessive oil drip.

SUMMARY OF INVENTION

It is a primary object of this invention to provide a lubricating pack specifically designed for paper shredders, which completely eliminates the use of conventional lubrication system requiring complicated mechanical devices so as to reduce the number of components and labor cost, whereby lubrication of the cutting blades may be achieved without increasing the manufacturing cost of the paper shredders.

It is another object of this invention to provide a lubricating pack specifically designed for paper shredders, which eradicate the conventional oil drip adopted by the conventional lubrication system, that ensures uniform lubrication without worrying the hazards possibly resulted from excessive oil drip.

It is yet a further object of this invention to provide a lubricating pack specifically designed for paper shredders, which can be implemented in shredders of any name brands or shredding modes.

To achieve the above objectives and to overcome the drawbacks of the conventional art, this invention provides a lubricating pack having a venting hole or holes and specifically designed for paper shredders, including a piece of oiled paper saturated with lubricant placed between two jackets that are each provided at an inner layer thereof with an oil-seepage-proof film. The two jackets are then formed with a first seal sealed around their peripheries to form a lubricating pack having a laminating construction. The lubricating pack is fed into the paper shredder through a paper inlet to the paper shredder under auto mode to be shredded by the paper shredder. Accordingly, the cutting blades of the paper shredder would be able to contact the lubricant contained in the oiled paper during the process of shredding the lubricating pack, so as to provide lubrication between cutting blades of the paper shredder, thereby extending the lifespan of the paper shredder. Furthermore, to prevent the lubricant from spurting upwards and out of the paper inlet of the paper shredder caused by air compressed by the cutting blades that shred a tail end of the lubricating pack, a second seal may be formed at an inward of the peripheries, where plural venting holes are preformed between the first seal at the periphery and second seal inward of the periphery.

BRIEF DESCRIPTION OF THE DRAWINGS

These and other modifications and advantages will become even more apparent from the following detained description of a preferred embodiment of the invention and from the drawings in which.

DETAILED DESCRIPTION OF THE INVENTION

Figure 1:
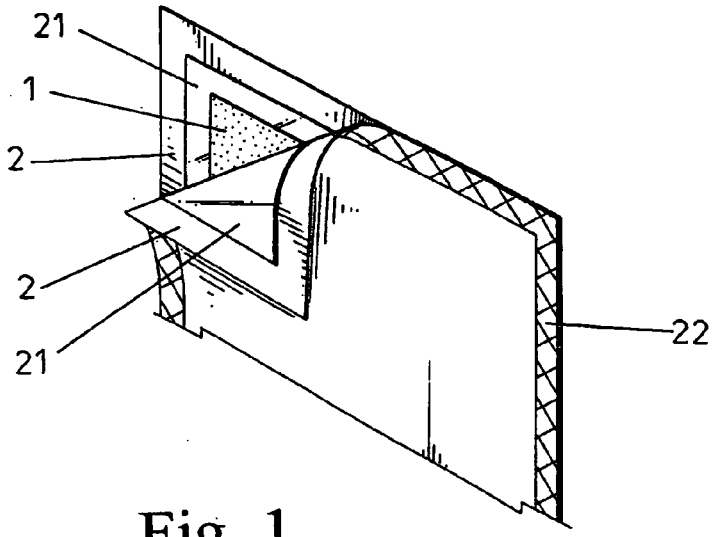
FIG. 1 is a perspective view illustrating a first embodiment for a lubricating pack specifically designed for paper shredders according to this invention.

FIG. 1 illustrates a perspective view of a first embodiment of a lubricating pack specifically designed for paper shredders according to this invention. A piece of oiled paper 1 saturated with lubricant is placed between two jackets that are each provided at an inner layer thereof with an oil-seepage-proof film 21. The jackets 2 may be made of conventional paper or plastic films. The jackets 2 sandwich the oiled paper therebetween and then formed with a first seal 22 around their periphery to form a lubricating pack 3 having a laminating construction.

Figure 2:
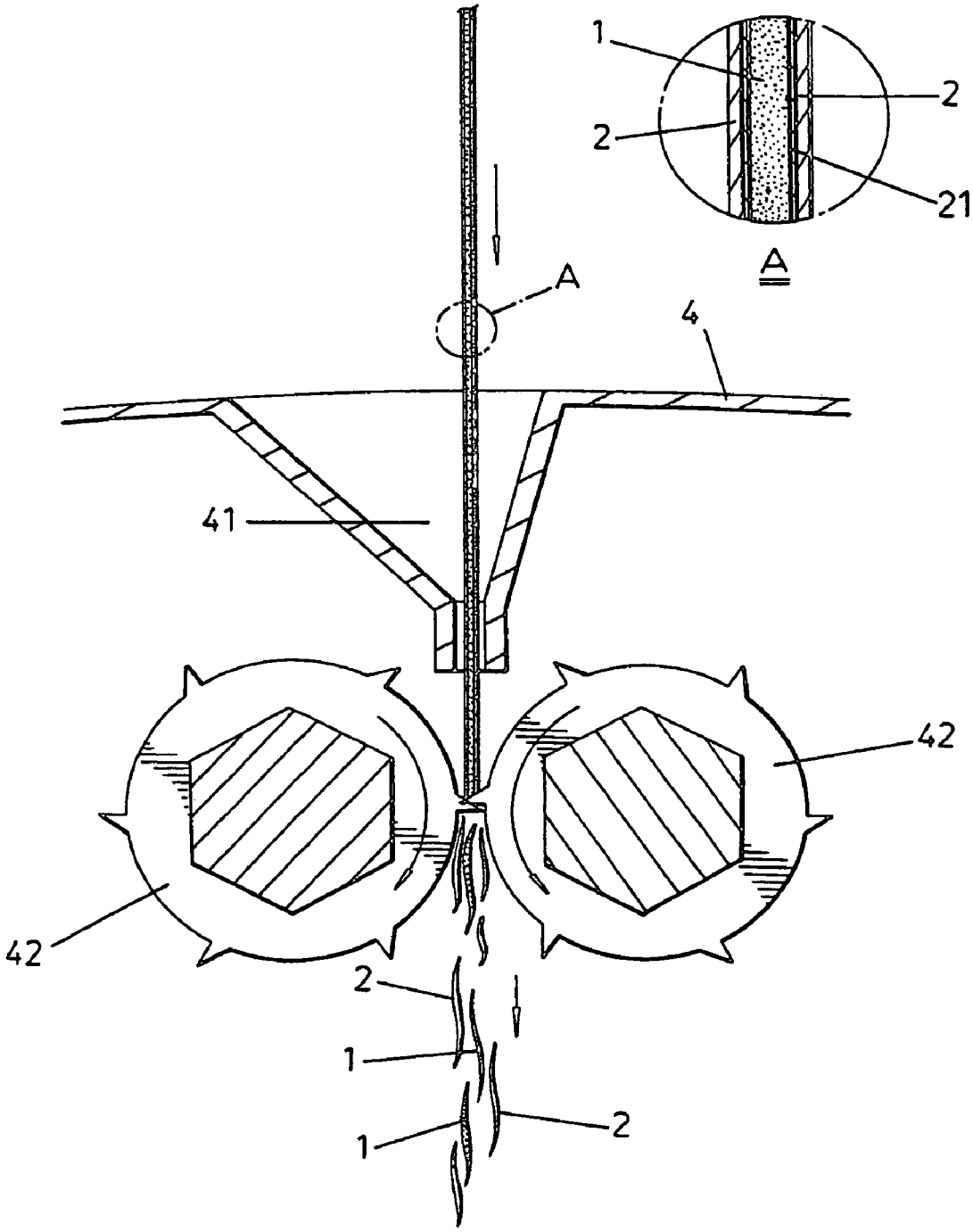
FIG. 2 is a schematic drawing illustrating how to embody the lubricating pack specifically designed for paper shredders according to this invention.

FIG. 2 is a schematic drawing illustrating how to embody the lubricating pack 3 specifically designed for paper shredders according to this invention. As shown in FIG. 2, the lubricating pack 3 specifically designed for paper shredders according to this invention is directly fed into a paper inlet 41 of a paper shredder 4 under auto mode to shred the lubricating pack 3. Accordingly, the cutting blades 42 of the paper shredder 4 would contact the lubricant contained in the oiled paper 1 directly during the process of shredding the lubricating pack 3, so as to provide lubrication between cutting blades 42 of the paper shredder 4.

In the above embodiment, when the cutting blades 42 of the shredder 4 shred a tail end of the lubricating pack 3, it is likely that the lubricant remained in the oiled paper 1 may spurt upwards and out of the paper inlet 41 of the shredder 4 caused by air compressed along with the air in the lubricant pack 3 that is compressed by the cutting blades at the instance that the lubricating pack 3 ruptures thereby startling or endangering the users.

Figure 3:
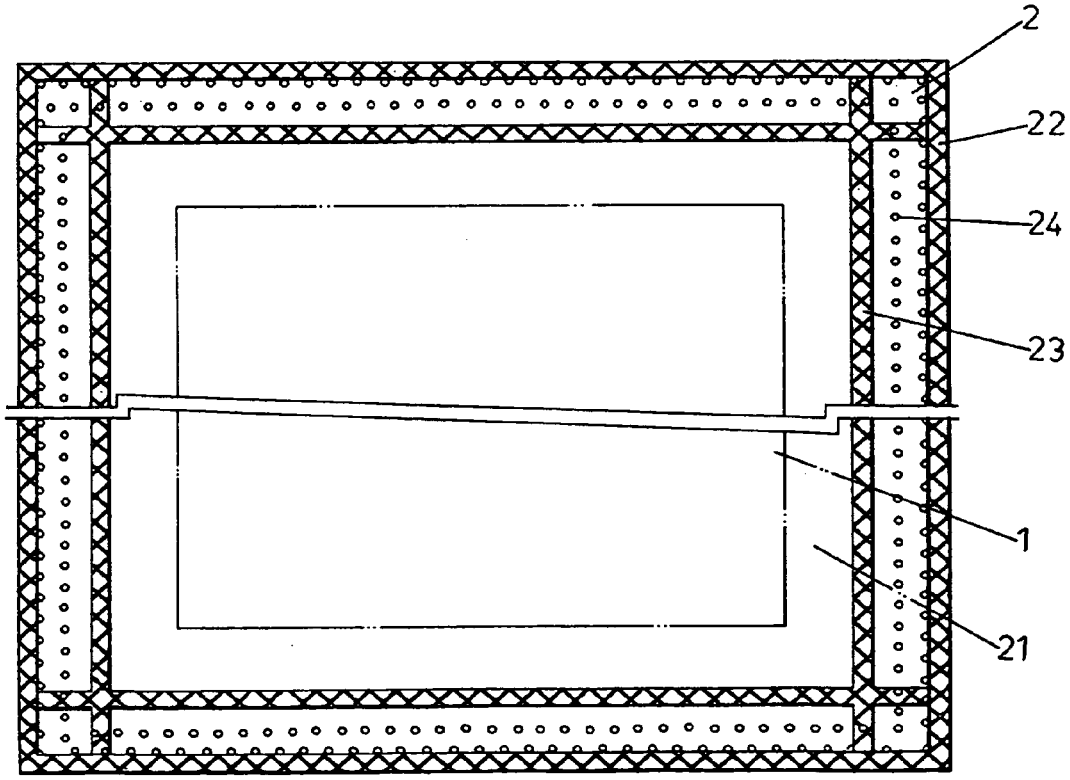
FIG. 3 is a perspective view illustrating a second embodiment for a lubricating pack specifically designed for paper shredders according to this invention.

To resolve the above scenario while embodying the first embodiment, a second embodiment for a lubricating pack specifically designed for paper shredders according to this invention as shown in FIG. 3 is provided. In this embodiment, a second seal may be formed inward of the periphery, where plural venting holes are performed between the first seal at the periphery and second seal inward of the periphery, a second seal 23 is formed inward of the first seal 22 at the periphery, where plural venting holes 24 are performed between the first seal 22 at the periphery and second seal 24 inward of the periphery, such that in the process that the cutting blades 42 of the shredder 4 shred the lubricating pack 3, the lubricant remained in the oiled paper 1 is prevented from spurting upwards and out of the paper inlet 41 of the shredder 4, because the air in the lubricant pack 3 may leak from the venting outwards at any time so as to prevent the air in the lubricant pack 3 from being compressed by the cutting blades 42.

The use of the lubricating pack specifically designed for paper shredders according to this invention to lubricate the cutting blades is relatively easy for user while ensuring uniform contact between the cutting blades and the lubricant. More than one lubricating pack may be shredded, if necessary, to provide additional lubricating effects. In addition, the lubricating pack specifically designed for paper shredders according to this invention can be made available through ordinary distribution channels, where the users only need to shred the lubricating pack in order to achieve the objective of lubricating the cutting blades of the paper shredder. Accordingly, the lubricating pack specifically designed for paper shredders is not limited to be implemented in paper shredders of specific name brands or shredding modes.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

The invention claimed is:

1. A lubricating pack having at least one venting hole and specifically designed for a paper shredder, comprised of: a piece of paper saturated with lubricant sandwiched between two jackets with at least one seal around the periphery, and at least one venting hole inward of the periphery.

2. The lubricating pack having at least one venting hole and specifically designed for a paper shredder of claim 1, wherein said jackets are each provided with an oil-seepage-proof film.

3. The lubricating pack of claim having at least one venting hole and specifically designed for a paper shredder of claim 1, wherein said jackets are each made of conventional paper or plastic films.

4. A lubricating pack having at least one venting hole and specifically designed for a paper shredder, comprised of: a lubricant sandwiched between two jackets with at least one seal around the periphery, and at least one venting hole inward of the periphery.

* * * * *